US007420454B2

(12) United States Patent
Takagi et al.

(10) Patent No.: US 7,420,454 B2
(45) Date of Patent: Sep. 2, 2008

(54) CEMENT RESISTOR

(75) Inventors: Katsumi Takagi, Ina (JP); Koichi Hirasawa, Ina (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 11/797,542

(22) Filed: May 4, 2007

(65) Prior Publication Data

US 2007/0262845 A1 Nov. 15, 2007

(30) Foreign Application Priority Data

May 9, 2006 (JP) ..... 2006-130795

(51) Int. Cl.
*H01C 1/02* (2006.01)

(52) U.S. Cl. ..... 338/226; 338/245; 338/250; 29/611

(58) Field of Classification Search ..... 338/226, 338/237, 245–246, 248, 250, 252, 277; 29/611, 29/613
See application file for complete search history.

(56) References Cited

U.S. PATENT DOCUMENTS 3,772,452 A * 11/1973 Usowski ..... 174/522
4,210,800 A * 7/1980 Van Bokestal et al. ..... 219/544
4,333,069 A * 6/1982 Worth et al. ..... 338/315
4,672,358 A * 6/1987 Pryst et al. ..... 338/226
4,678,890 A * 7/1987 Sorrow ..... 219/121.6
5,300,919 A * 4/1994 Caddock ..... 338/250
6,317,024 B1 * 11/2001 Orii ..... 338/276

* cited by examiner

*Primary Examiner*—K. Richard Lee
(74) *Attorney, Agent, or Firm*—Westerman, Hattori, Daniels & Adrian, LLP.

(57) ABSTRACT

A resistive element in the form of a bent metal plate is placed in a box-shaped case and has electrodes exposed out of the box-shaped case. A heat radiator in the form of a bent metal plate is also placed in the box-shaped case and has heat radiating electrodes exposed out of the box-shaped case. The resistive element and the heat radiator are held out of contact with each other and disposed in criss-cross relation to each other. The box-shaped case is filled with a cement material in surrounding relation to the resistive element and the heat radiator.

5 Claims, 4 Drawing Sheets

CEMENT RESISTOR

BACKGROUND OF THE INVENTION

1. Field of the Invention

The present invention relates to a cement resistor having a bent resistive element of metal which is placed in a box-shaped ceramic case with an open side and sealed by a cement material that is introduced through the open side to fill the ceramic case.

2. Description of the Related Art

Cement resistors are known in the art as small-size, high-power-capacity current-detecting resistors. For example, reference should be made to Japanese laid-open patent publication No. 11-251103. One cement resistor has a resistive element in the form of a bent plate of copper-nickel alloy which is placed in a box-shaped ceramic case and sealed by a cement material that fills the ceramic case. The cement resistor is fire-resistant, has a low resistance value of several tens mΩ or lower which is easy to obtain, and has a good temperature coefficient of resistance (TCR). Therefore, the cement resistor is widely used in the art as a small-size, high-power-capacity current-detecting resistor.

The heat dissipation of resistors is of great importance to small-size, high-power-capacity resistors. Various proposals have been made to improve the heat dissipation of resistors. For example, reference should be made to Japanese patent No. 3358844.

Demands are growing in the art for cement resistors which are of higher power capabilities, smaller sizes, higher performance, and greater reliability.

SUMMARY OF THE INVENTION

It is an object of the present invention to provide a cement resistor which has a better heat dissipation capability for a smaller size and a higher power capability.

According to the present invention, there is provided a cement resistor comprising a box-shaped case, a resistive element comprising a bent metal plate disposed in the box-shaped case and having electrodes exposed out of the box-shaped case, a heat radiator comprising a bent metal plate disposed in the box-shaped case and having heat radiating electrodes exposed out of the box-shaped case, the resistive element and the heat radiator being held out of contact with each other and disposed in criss-cross relation to each other, and a cement material filling the box-shaped case in surrounding relation to the resistive element and the heat radiator.

With the above arrangement, the heat radiator in the form of a bent metal plate is placed in the box-shaped case, typically a ceramic case, out of contact with the resistive element in criss-cross relation thereto. The heat radiator is effective to discharge heat generated by the resistive element efficiently to a mounting board on which the cement resistor is mounted. The box-shaped case has an open side and a bottom opposite to the open side. The heat radiator has portions exposed out of the open side, and the heat radiating electrodes thereof are bent from the exposed portions and extend along the open side. Therefore, the heat radiating electrodes have a large mounting surface which provides a strong junction between the heat radiator and the mounting board.

The above and other objects, features, and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1A:
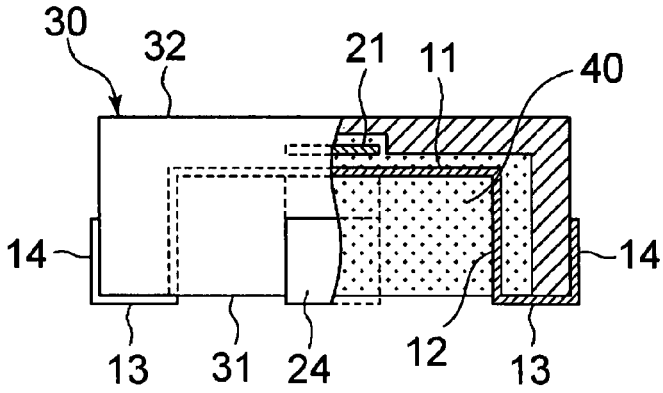
FIG. 1A is a front elevational view, partly in cross section, of a cement resistor according to an embodiment of the present invention.

Embodiments of the present invention will be described below with reference to the accompanying drawings. Like or corresponding parts are denoted by like or corresponding reference characters throughout views.

Figure 1B:
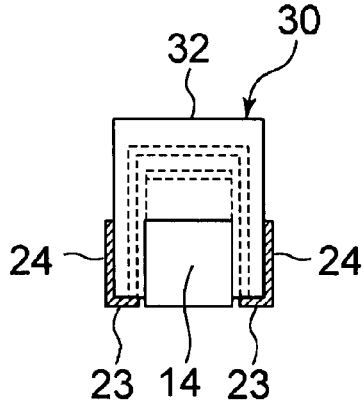
FIG. 1B is a side elevational view, partly in cross section, of the cement resistor shown in FIG. 1A.

FIGS. 1A and 1B show in front elevation, partly in cross section, a cement resistor according to an embodiment of the present invention. As shown in FIGS. 1A and 1B, the cement resistor has a resistive element 10 in the form of a metal plate and a heat radiator 20 in the form of a metal plate. The resistive element 10 and the heat radiator 20 are fixedly joined to a box-shaped ceramic case 30 having an open side 31. The resistive element 10 and the heat radiator 20 have respective portions placed in the ceramic case 30 and sealed by a cement material 40 that is introduced through the open side 31 into the ceramic case 30. The ceramic case 30 has a bottom 32 opposite to the open side 31. When the cement resistor is mounted in place on a mounting board (not shown), the open side 31 is positioned to face the mounting board and the bottom 32 is positioned to face away from the mounting board. The resistive element 10 has flat portions 13 exposed out of the ceramic case 30 and serving as electrodes. The flat portions 13 of the resistive element 10 are connected to a wiring pattern on the mounting board by solder or the like. The cement resistor is thus surface-mounted on the mounting board.

Figure 2A:
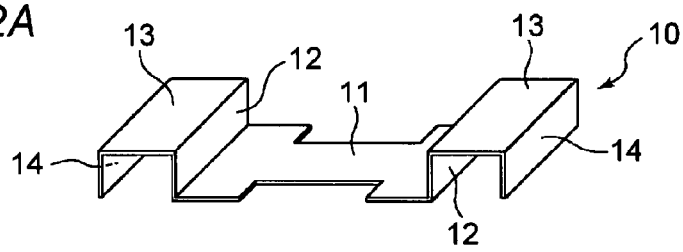
FIG. 2A is a perspective view of a resistive element of the cement resistor.

The resistive element 10 is formed by bending a thin plate of a metallic resistive material such as a copper-nickel alloy or the like, for example, as shown in FIG. 2A. Specifically, as shown in FIGS. 2A and 2C, the resistive element 10 has a central region 11 extending parallel to the open side 31 of the ceramic case 30 within the ceramic case 30, a pair of vertical regions 12 bent perpendicularly from respective opposite ends of the central region 11 and having portions exposed out of the open side 31, a pair of flat regions 13 bent respectively away from each other from the respective ends of the vertical regions 12 and extending parallel to the open side 31 and upper surfaces 33 of the ceramic case 30, and a pair of vertical regions 14 bent perpendicularly from the respective ends of the flat regions 13 and extending parallel to the vertical regions 12 along outer wall surfaces 34 of the ceramic case 30. The vertical regions 12, the flat regions 13, and the vertical regions 14 are symmetrical with respect to the central region 11. The central region 11 has a central narrower section to keep itself spaced from the heat radiator 20 so that the heat radiator 20 and the resistive element 10 are held out of contact with each other. The flat regions 13 and the vertical regions 14 provide electrodes of the cement resistor when the flat regions 13 are joined to land patterns of the mounting board by solder or the like.

Figure 2B:
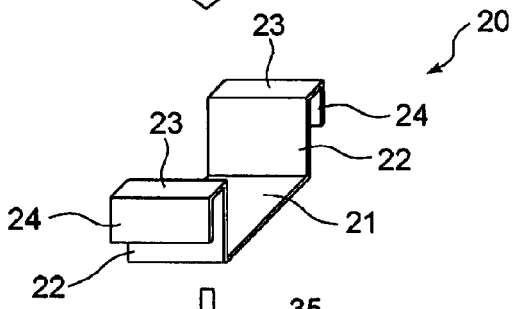
FIG. 2B is a perspective view of a heat radiator of the cement resistor.
Figure 2C:
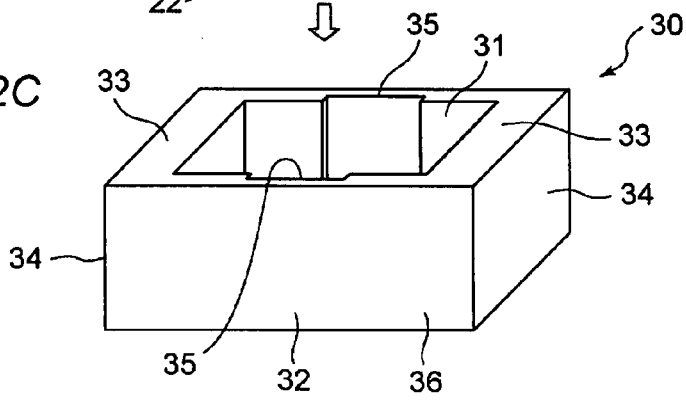
FIG. 2C is a perspective view of a ceramic box of the cement resistor.
Figure 3A:
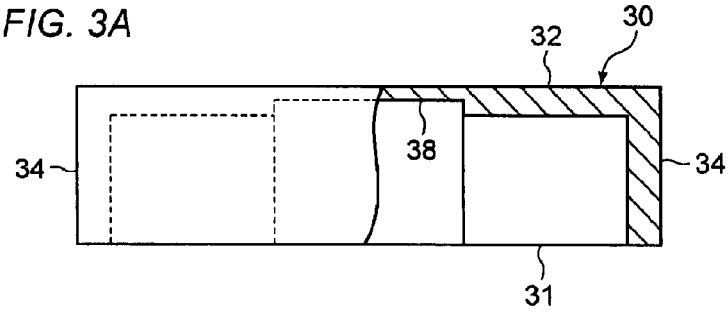
FIG. 3A is a front elevational view, partly in cross section, of a ceramic case of the cement resistor, the cross section being taken substantially centrally in the ceramic case.
Figure 3B:
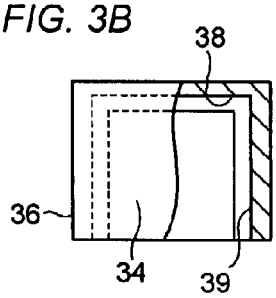
FIG. 3B is a side elevational view, partly in cross section, of the ceramic case, the cross section being taken substantially centrally in the ceramic case.
Figure 3C:
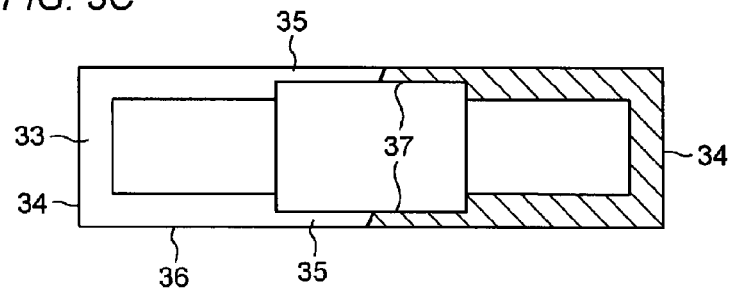
FIG. 3C is a bottom view, partly in cross section, of the ceramic case, the cross section being taken substantially centrally in the ceramic case.

The heat radiator 20 is formed by bending a thin plate of a highly thermally conductive material such as copper, for example, as shown in FIG. 2B. Specifically, as shown in FIGS. 2B and 2C, the heat radiator 20, which is in the form of a thin plate of metal, has a central region 21 extending parallel to the open side 31 of the ceramic case 30 within the ceramic case 30, a pair of vertical regions 22 bent perpendicularly from respective opposite ends of the central region 11 and having portions exposed out of the open side 31, a pair of flat regions 23 bent respectively away from each other from the respective ends of the vertical regions 22 and extending parallel to the open side 31 and upper surfaces 35 of the ceramic case 30, and a pair of vertical regions 24 bent perpendicularly from the respective ends of the flat regions 13 and extending parallel to the vertical regions 22 along outer wall surfaces 36 of the ceramic case 30. The vertical regions 22, the flat regions 23, and the vertical regions 24 are symmetrical with respect to the central region 21. The flat regions 23 and the vertical regions 24 provide heat radiating electrodes of the cement resistor when the flat regions 23 are joined to land patterns of the mounting board by solder or the like.

As shown in FIGS. 2C and 3A through 3C, the ceramic case 30 is of an elongate box-shaped configuration and has, in addition to the open side 31 and the bottom 32 which is closed, a pair of longitudinally opposite walls having the respective outer wall surfaces 34, and a pair of transversely opposite walls having the respective outer wall surfaces 36. The ceramic case 30 is made of a material containing about 96% of alumina, for example, to make it highly thermally conductive. The ceramic case 30 has a pair of recesses 37 defined respectively in central inner wall surfaces of the transversely opposite walls and a recess 38 defined in a central inner wall surface of the bottom 32. The vertical regions 22 of the heat radiator 20 are disposed respectively in the recesses 37, and the central region 21 of the heat radiator 20 is disposed in the recess 38. In the ceramic case 30, the heat radiator 20 is spaced from and hence kept out of contact with the resistive element 10. The recesses 37, 38 also function to position the heat radiator 20 in the ceramic case 30. The flat regions 13 of the resistive element 10 engage the respective upper surfaces 33 which are contiguous to the outer wall surfaces 34, and the flat regions 23 of the heat radiator 20 engage the respective upper surfaces 35 which are contiguous to the outer wall surfaces 36.

The cement material 40 comprises a paste-like insulative sealing material containing an alumina powder and a silica powder. Using a dispenser, the cement material 40 is introduced through the open side 31 into the ceramic case 30 with the resistive element 10 and the heat radiator 20 housed therein until the ceramic case 30 is fully filled with cement material 40. When the cement material 40 is hardened by heating, it forms a sealing mass surrounding the resistive element 10 and the heat radiator 20. The cement material 40 is introduced into the ceramic case 30 up to the open side 31 to produce a resistor assembly in the shape of a rectangular parallelepiped.

Figure 4:
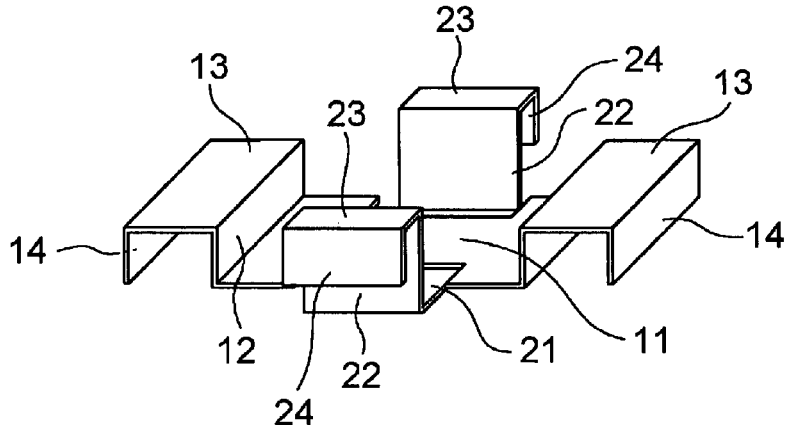
FIG. 4 is a perspective view of the resistive element and the heat radiator which are assembled together in a criss-cross configuration.

As shown in FIG. 4, when the resistive element 10 and the heat radiator 20 are assembled together within the ceramic case 30, the central region 21 of the heat radiator 20 and the central region 11 of the resistive element 10 are held out of contact with each other and extend in a criss-cross pattern with the gap between the central regions 21, 11 being filled with the cement material 40.

Figure 5A:
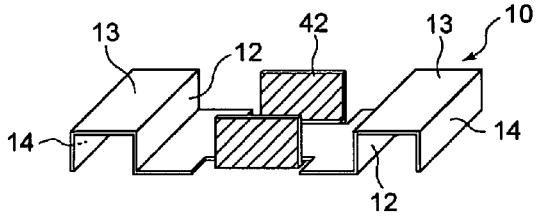
FIGS. 5A and 5B are perspective views showing a modified assembly of the resistive element and the heat radiator.
Figure 5B:
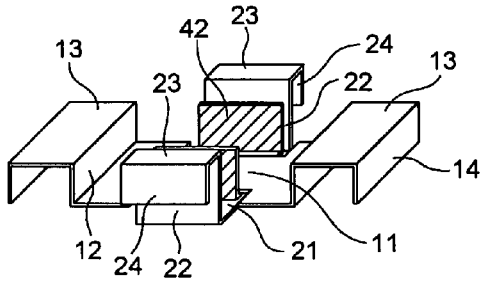

FIGS. 5A and 5B show in perspective a modified assembly of the resistive element 10 and the heat radiator 20. As shown in FIGS. 5A and 5B, an insulating member 42 other than the cement material 40 is inserted between the central region 21 of the heat radiator 20 and the central region 11 of the resistive element 10 to keep the central regions 21, 11 out of contact with each other. Specifically, the insulating member 42, which is of a channel-shaped configuration, is placed around the central region 11 of the resistive element 10, as shown in FIG. 5A, such that a central region of the insulating member 42 is held against the lower surface of the central region 11. Then, as shown in FIG. 5B, the heat radiator 20 is placed beneath the insulating member 42 such that the central region 21 of the heat radiator 20 is held against the lower surface of the central region of the insulating member 42. The insulating member 42 is now positioned between the resistive element 10 and the heat radiator 20. The insulating member 42 should preferably be made of a highly thermally conductive material with a high content of alumina, like the material of the ceramic case 30.

Figure 6:
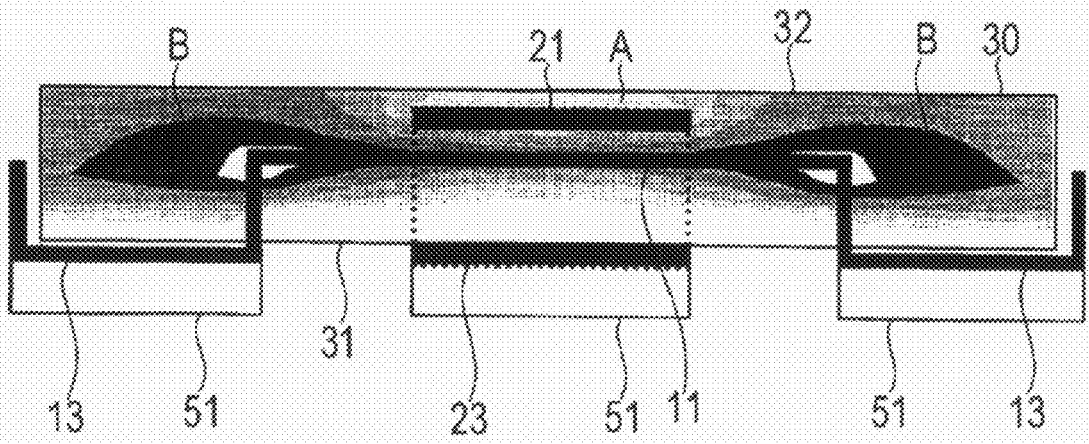
FIG. 6 is a view showing the results of a simulation of a temperature distribution in the ceramic case of the cement resistor which is mounted in place on a mounting board.

FIG. 6 shows the results of a simulation of a temperature distribution in the ceramic case 30 of the cement resistor which is mounted in place on the mounting board. As described above, when the cement resistor is mounted in place on the mounting board, the open side 31 is positioned to face the mounting board and the bottom 32 is positioned to face away from the mounting board. When the cement resistor is mounted on the mounting board, the flat regions 13 of the resistive element 10 and the flat regions 23 of the heat radiator 20 are connected as electrodes and heat radiating electrodes, respectively, to respective land patterns 51 on the mounting board which typically comprises a highly thermally conductive aluminum board. When an electric current flows through the resistive element 10, the resistive element 10 generates heat and the central region 11 thereof generates intensive heat. As the flat regions 13 of the resistive element 10 are connected as electrodes to the respective land patterns 51, part of the generated heat flows through the resistive element 10 to the mounting board, with the rest of the generated heat being dissipated into the atmosphere through the cement material 40 and the outer wall surfaces 34, 36 of the ceramic case 30.

Since the flat regions 23 of the heat radiator 20 are connected as heat radiating electrodes to the corresponding land patterns 51, the heat generated by the resistive element 10 can effectively be discharged into the mounting board through the flat region 23. Particularly, the temperature of an area A above the central region 11 of the resistive element 10 rises most intensively by the heat generated by the resistive element 10. Therefore, the central region 21 of the heat radiator 20 is positioned closely to the area A in crossing relation to the central region 11 of the resistive element 10. The heat generated by the central region 11 of the resistive element 10 is effectively absorbed by the central region 21 of the heat radiator 20, so that the temperature of the area A is prevented from rising excessively. In FIG. 6, darker areas, denoted by B, represent areas where a high temperature rise occurs and lighter areas represent areas where a low temperature rise occurs. The results of a simulation on an inventive cement resistor of a 15 W rating and a comparative cement resistor free of the heat radiator 20 indicate that the temperature rise in the area A of the inventive cement resistor was about one quarter of the temperature rise in the area A of the comparative cement resistor. In the inventive cement resistor, the temperature rise in the areas. B from the temperature of the mounting board was limited to about 100 to 120° C.

Inasmuch as the temperature of the area A above the central region 11 of the resistive element 10 rises most intensively by the heat generated by the resistive element 10, it is preferable to position the central region 11 of the resistive element 10 downwardly closer to the open side 31 of the ceramic case 30 and to position the central region 21 of the heat radiator 20 upwardly closer to the bottom 32 of the ceramic case 30 in the area where the central regions 11, 21 are held out of contact with each other in crossing relation to each other. This arrangement is effective to reduce the temperature rise of the cement resistor.

The cement resistors used in the above simulation had a length of 19 mm, a width of 8 mm, and a height of 6.5 mm, had resistance values in the range from 8 to 50 mΩ, and TCRs of about ±100 ppm/° C. The heat resistor 20 used in the simulation was a copper plate having a thickness of 0.3 mm and a width of 5.5 mm. It was confirmed by the simulation that the heat radiator 20 placed in the cement resistor was effective to allow the cement resistor with a power rating ranging from 5 to 15 W to be small in size, of a higher power capability, high in performance, and highly reliable.

In the above embodiment, the heat radiator is in the form of a copper plate. The copper plate should preferably be plated with nickel or tin to prevent itself from being oxidized and to produce a better soldering junction between the heat radiating electrodes and the mounting board.

Although certain preferred embodiments of the present invention have been shown and described in detail, it should be understood that various changes and modifications may be made therein without departing from the scope of the appended claims.

What is claimed is:

1. A cement resistor comprising:

a box-shaped case;

a resistive element comprising a bent metal plate disposed in said box-shaped case and having electrodes exposed out of said box-shaped case;

a heat radiator comprising a bent metal plate disposed in said box-shaped case and having heat radiating electrodes exposed out of said box-shaped case, said resistive element and said heat radiator being held out of contact with each other and disposed in criss-cross relation to each other; and a cement material filling said box-shaped case in surrounding relation to said resistive element and said heat radiator.

2. A cement resistor according to claim 1, wherein said box-shaped case has an open side and a bottom opposite to said open side, said resistive element being disposed closely to said open side and said heat radiator being disposed closely to said bottom in an area where said resistive element and said heat radiator are disposed in criss-cross relation to each other.

3. A cement resistor according to claim 1, wherein said box-shaped case has recesses defined therein, said heat radiator being disposed in said recesses.

4. A cement resistor according to claim 1, further comprising:

an insulating member disposed in said box-shaped case to keep said resistive element and said heat radiator out of contact with each other.

5. A cement resistor according to claim 1, wherein said resistive element has a central narrower section to keep the resistive element spaced from said heat radiator.

* * * * *